US012221973B2

(12) United States Patent
Zheng et al.

(10) Patent No.: US 12,221,973 B2
(45) Date of Patent: Feb. 11, 2025

(54) SELF-ASPIRATING AND GAS-LIQUID DISPERSING IMPELLERS

(71) Applicant: Jiangnan University, Wuxi (CN)

(72) Inventors: Zhiyong Zheng, Wuxi (CN); Minjie Gao, Wuxi (CN); Xiaobei Zhan, Wuxi (CN)

(73) Assignee: Jiangnan University, Wuxi (CN)

( * ) Notice: Subject to any disclaimer, the term of this patent is extended or adjusted under 35 U.S.C. 154(b) by 18 days.

(21) Appl. No.: 18/337,093

(22) Filed: Jun. 19, 2023

(65) Prior Publication Data

US 2023/0332612 A1 Oct. 19, 2023

Related U.S. Application Data

(63) Continuation of application No. PCT/CN2022/126121, filed on Oct. 19, 2022.

(30) Foreign Application Priority Data

Feb. 14, 2022 (CN) ..... 202210132423.3

(51) Int. Cl.
*B01F 23/233* (2022.01)
*F04D 29/18* (2006.01)
*F04D 31/00* (2006.01)

(52) U.S. Cl.
CPC ..... *F04D 29/18* (2013.01); *F04D 31/00* (2013.01)

(58) Field of Classification Search
None
See application file for complete search history.

(56) References Cited

U.S. PATENT DOCUMENTS 3,108,146 A * 10/1963 Gross ..... B01F 23/2331 96/353
3,485,484 A * 12/1969 Quinchon ..... C02F 3/205 261/87
3,512,762 A * 5/1970 Umbricht ..... C02F 3/1284 210/219

(Continued)

FOREIGN PATENT DOCUMENTS

CN 2649170 Y 10/2004
CN 201135865 Y 10/2008

(Continued)

*Primary Examiner* — Kayla Mccaffrey
(74) *Attorney, Agent, or Firm* — IPRO, PLLC; Na Xu

(57) ABSTRACT

Disclosed are self-aspirating and gas-liquid dispersing impellers, belonging to the technical field of impellers. The self-aspirating and gas-liquid dispersing impellers include an stirring shaft, a hub, a disc and blades; the hub is coaxially sleeved on the stirring shaft, the disc is connected to the hub, a plurality of blades which extend in the radial direction are arranged on the circumferential side face of the disc, and a gas inlet channel is formed in the disc; each of the plurality of blades includes an upper curved surface and a lower curved surface, and a rotary cavity is embedded between the upper curved surface and the corresponding lower curved surface; and one side of the rotary cavity is a liquid facing surface. The impeller of the disclosure has the dual functions of radial gas-liquid dispersing and axial fluid mixing, effectively promotes microscopic mass transfer and macroscopic fluid delivery between gas and liquid phases.

10 Claims, 11 Drawing Sheets

(56) References Cited

U.S. PATENT DOCUMENTS

| | | | | |
|---|---|---|---|---|
| 4,018,859 | A * | 4/1977 | Muller | B01F 35/93 261/87 |
| 5,198,156 | A * | 3/1993 | Middleton | B01F 23/233 416/243 |
| 7,997,788 | B2 * | 8/2011 | Bell | B63H 1/265 261/87 |

FOREIGN PATENT DOCUMENTS

| | | | |
|---|---|---|---|
| CN | 101439275 | A | 5/2009 |
| CN | 101811004 | A | 8/2010 |
| CN | 204656506 | U | 9/2015 |
| CN | 105854664 | A | 8/2016 |
| CN | 106268579 | A | 1/2017 |
| CN | 209810077 | U | 12/2019 |
| CN | 113731219 | A | 12/2021 |
| CN | 114632444 | A | 6/2022 |
| JP | 2021098152 | A | 7/2021 |

* cited by examiner

A-A

SELF-ASPIRATING AND GAS-LIQUID DISPERSING IMPELLERS

TECHNICAL FIELD

The disclosure relates to self-aspirating and gas-liquid dispersing impellers, and belongs to the technical field of impellers.

BACKGROUND

Gas-liquid dispersion widely occurs in process units of aerobic fermentation, oxidation reaction, hydrogenation reaction, chlorination reaction, gas flotation, biological aeration and the like. Engineers developed bubble column, airlift reactors, radial flow impellers with a gas-liquid dispersing function, gas-liquid mixing nozzles, aerators, and the like to achieve effective gas-liquid dispersing and mass transfer processes.

Self-aspirating impellers are a kind of radial flow impeller. It is a gas-liquid contact apparatus which does not require a gas supply apparatus but rather generates negative pressure and draws in external gas when the impeller rotates in the liquid. Common self-aspirating impellers include three types: a turbine with hollow tubes, a hollow turbine and a closed turbine. The most common self-aspirating impeller is the hollow turbine with backward curved tail ends. Its working principle is that during high-speed rotation process, the negative pressure is formed at the tail ends of the hollow turbine, and aspirated gas undergoes cavitation with the liquid near the backward curved tail ends to form small bubbles, thereby achieving gas-liquid dispersion and mass transfer. The gas-liquid two-phase fluid generates millimeter or even centimeter-sized bubbles by means of the cavitation effect, and the efficiency of producing bubbles is not very high. If micrometer-sized bubbles are to be formed, high power input is required and gas processing capability is limited. In the cavitation process under a negative pressure condition, gas and liquid phases collide violently to generate small bubbles. The heat dissipation and energy loss caused by the violent collision are serious. In fact, in the design process of novel gas-liquid dispersing impellers (such as Bakker Turbine), the cavitation effect is required to be avoided on the back surfaces of the plurality of blades.

A jet type gas-liquid dispersing apparatus based on a Venturi tube principle needs to utilize an external circulating pump to continuously deliver liquid, the liquid flowing at high speed generates negative pressure in a contracted channel so as to suck gas, and gas-liquid collision, stretching and shearing action are formed in an expansion area, thereby forming small bubbles. In this process, inlet-outlet pressure difference and liquid flow rate are the key factors. According to the gas-liquid dispersing apparatus based on a static mixer, dispersion and mixing of gas and liquid phases are realized by means of flow resistance and flow state change of internals and channels of the mixer. Similar to the jet type gas-liquid dispersing apparatus, because the external circulating pump and a circulating pipeline are required, the apparatus is not likely to be accepted for aerobic fermentation with high requirements on sanitation and sterility. Head loss in Venturi tube and the static mixer is a main cause for the high energy consumption of the gas-liquid dispersing apparatus.

In addition, the gas-liquid dispersing impellers belong to radial flow impellers, which are often relatively independent with other types of impellers in terms of function. For the reaction process involving gas-liquid dispersing and material mixing simultaneously, a combination of different impellers is required, which increases the equipment costs and reduces production efficiency. However, it is difficult to realize both the gas-liquid dispersing and efficient mixing by means of one impeller in the prior art.

SUMMARY

In order to solve the problems, the disclosure provides self-aspirating and gas-liquid dispersing impellers. The impellers have dual functions of radial gas-liquid dispersing and axial fluid mixing, effectively promote microscopic mass transfer and macroscopic fluid delivery between gas and liquid phases, and are suitable for a multiphase flow reaction system with various requirements on gas-liquid mass transfer, mixing, heat transfer and the like.

The disclosure provides self-aspirating and gas-liquid dispersing impellers, including a stirring shaft, a hub, a disc and blades; the stirring shaft is a hollow stirring shaft, the hub is coaxially sleeved on the stirring shaft, the disc is connected to the hub, a plurality of blades which extend in the radial direction are arranged on the circumferential side face of the disc, and a gas inlet channel is formed in the disc; each of the plurality of blades includes an upper curved surface and a lower curved surface, a rotary cavity is embedded between the upper curved surface and the corresponding lower curved surface, and the rotary cavity communicates with the hollow stirring shaft through the gas inlet channel; and one side of the rotary cavity is a liquid facing surface, the other side of the rotary cavity is a liquid backing surface, a liquid inlet channel is formed in the liquid facing surface, and the liquid inlet channel communicates with the corresponding rotary cavity.

In one embodiment of the disclosure, an air groove is formed in an inner side of the hub, and a plurality of side holes are formed on the side of the stirring shaft; and an outer side of the air groove communicates with the gas inlet channel of the disc, and the inner side of the air groove communicates with the side holes of the stirring shaft.

In one embodiment of the disclosure, sealing rings are further arranged between the stirring shaft and the hub, the number of the sealing rings is two, the side holes and the air groove are positioned between the two sealing rings, and the disc is connected to the plurality of blades in a welded or detachable manner.

In one embodiment of the disclosure, the projections of the upper curved surfaces and the lower curved surfaces of the plurality of blades in a plane of the disc are rectangular, fan-shaped or trapezoidal; the upper curved surfaces close to the directions of the liquid facing surfaces gradually slope towards the horizontal plane, and the upper curved surfaces close to the directions of the liquid backing surfaces form an inclination angle of 10-60 degrees with a horizontal plane; and the lower curved surfaces close to the directions of the liquid facing surfaces form an inclination angle of 10-45 degrees with a horizontal plane, and the lower curved surfaces close to the directions of the liquid backing surfaces gradually slope towards the horizontal plane.

In one embodiment of the disclosure, the rotary cavity is a single truncated cone cavity or a combination of a cylindrical cavity and a truncated cone cavity, and a cross-sectional area of an outer side end face of the rotary cavity is smaller than that of an inner side end face.

In one embodiment of the disclosure, each of the plurality of blades further includes an outer side face and an inner side face, the outer side face and the inner side face are vertical planes or cylindrical curved surfaces; the liquid facing surfaces are configured to guide liquid to enter the plurality of blades, the angle between the liquid facing surface and the plane of the disc is 60-90°, and the upper curved surface and the corresponding lower curved surface converge on the corresponding liquid backing surface.

In one embodiment of the disclosure, when the rotary cavity is the combination of the cylindrical cavity and the truncated cone cavity, the ratio of a diameter of the outer side end face to a diameter of the inner side end face of the rotary cavity is 0.4-0.9, the ratio of a length of the rotary cavity to the diameter of the inner side end face is 1.2-4, the ratio of a height of the truncated cone cavity to the diameter of the inner side end face of the rotary cavity is 0.2-1, and the ratio of a width of each of the plurality of blades to the length of the rotary cavity is 1-2; and when the rotary cavity is the single truncated cone cavity, the ratio of the diameter of the outer side end face to the diameter of the inner side end face of the rotary cavity is 0.5-0.9, and the ratio of the length of the rotary cavity to the diameter of the inner side end face is 1.5-4.

In one embodiment of the disclosure, the cross-sectional area of the liquid inlet channel at the end adjacent to the liquid facing surface is larger than that of the end adjacent to the rotary cavity, the height of the liquid inlet channel at the end adjacent to the corresponding liquid facing surface is 0.2-0.75 of the diameter of the inner side end face of the corresponding rotary cavity, the height of the liquid inlet channel at the end adjacent to the cylindrical cavity is 0.1-0.4 of the diameter of the inner side end face of the corresponding rotary cavity.

In one embodiment of the disclosure, the ratio of the diameter of the gas inlet channel to the diameter of the outer side end face of the rotary cavity is 0.05-0.4.

In one embodiment of the disclosure, the number of the plurality of blades is 2-8, the plurality of blades are evenly distributed along the circumference of the disc, and the ratio of the length of the rotary cavity to the diameter of the disc is 0.2-0.8.

Beneficial Effects

1. The impeller of the disclosure has a gas self-aspirating function, gas inlet pressure may be reduced, even a gas compression device can be omitted directly, and the investment cost and the power consumption of the air compressor may be reduced.

2. The impeller of the disclosure has dual functions of radial gas-liquid dispersing and axial fluid mixing, effectively promotes microscopic mass transfer and macroscopic fluid delivery between gas and liquid phases, and is suitable for a multiphase flow reaction system with various requirements on gas-liquid mass transfer, mixing, heat transfer and the like.

3. The impeller of the disclosure utilizes shearing force generated in a rotation process. The plurality of blades guide the liquid into the rotary cavity from the liquid facing surfaces and produce high speed liquid rotation in the rotary cavity. This rotating shear force efficiently rotates and shears the gas core at the axis of the rotary cavity, resulting in micrometer-sized bubbles. The radial centrifugal force generated during the rotation of the impeller is utilized to promote negative pressure in the rotary cavity and allow the gas to be self-aspirated. The radial centrifugal force promotes the gas-liquid mixture to be sprayed out from the outer end face of the contracted rotary cavity in an accelerated manner. This further enhances the velocity difference and the shearing action between the gas and the liquid, leading to secondary fragmentation of bubbles. As a result, the tangential shear force and the radial centrifugal force can synergistically promote the specific surface area and the gas-liquid mass transfer efficiency of the bubbles.

4. According to the self-aspirating and gas-liquid dispersing impellers provided by the disclosure, violent gas-liquid two-phase contact modes such as 'collision', 'slapping' and 'blasting' are discarded, but liquid is guided to be in contact with gas in a high-speed rotation mode, and the energy dissipation of the impeller is efficiently converted into surface energy, thereby generating uniform micrometer-sized bubble groups.

5. The impeller of the disclosure utilizes the basic structures of the rotary cavity and the tangential liquid inlet channel, and then combines the inclinations of the upper curved surfaces and the lower curved surfaces in different spatial positions, thereby reducing the power number of the impeller and is favorable for exerting an energy-saving performance. The lower curved surfaces guide the fluid outside the plurality of blades to move axially, so that bubbles generated in the plurality of blades are conveyed to a farther area, and the cavitation effect of the fluid on the liquid backing surfaces is avoided. The impeller of the disclosure has the dual functions of radial gas-liquid dispersing and axial fluid mixing, effectively promotes microscopic mass transfer and macroscopic fluid delivery between gas and liquid phases, and is suitable for the multiphase flow reaction system with various requirements on gas-liquid mass transfer, mixing, heat transfer and the like.

Figure 1:
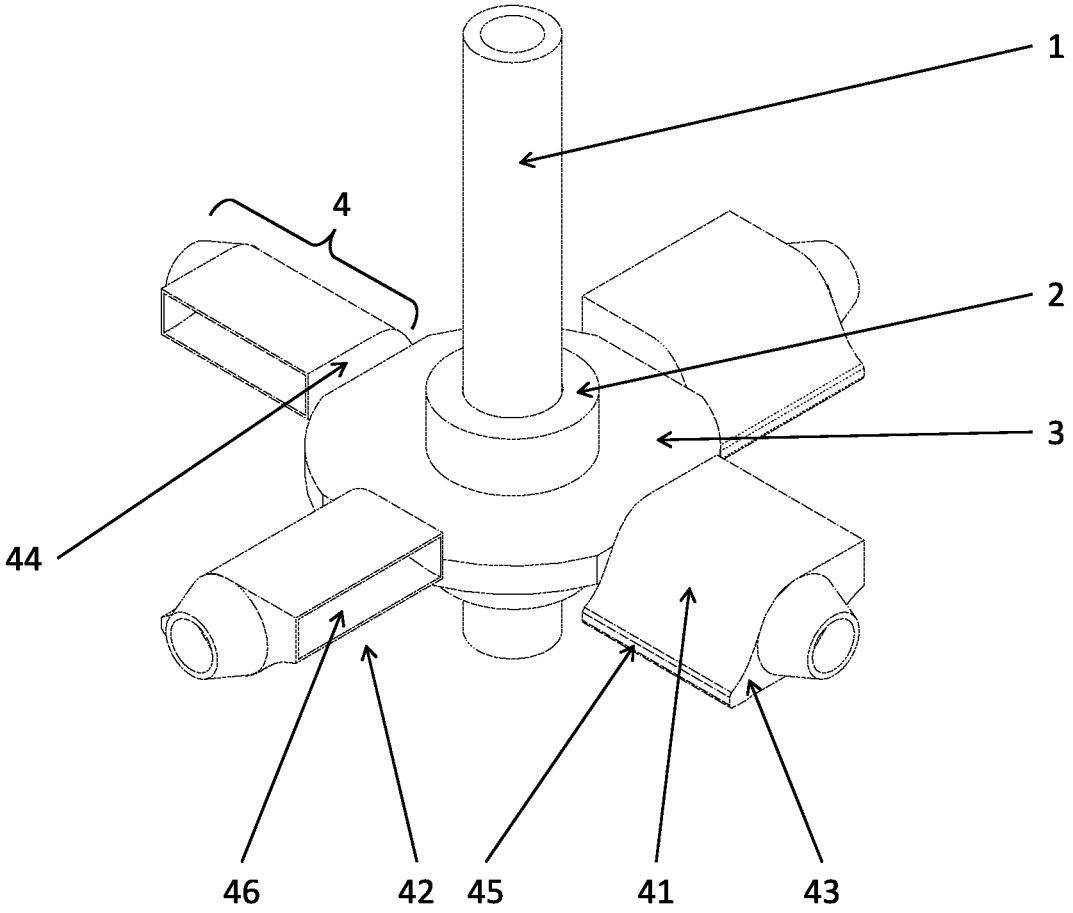
FIG. 1 is a perspective view of an impeller according to example 1.

Reference numerals: 1—stirring shaft; 2—hub; 3—disc; 4—blade; 11—sealing ring; 12—side hole; 21—air groove; 31—gas inlet channel; 41—upper curved surface; 42—lower curved surface; 43—outer side face; 44—inner side face; 45—liquid backing surface; 46—liquid facing surface; 47—truncated cone cavity; 48—cylindrical cavity; 49—liquid inlet channel; 50—rotary cavity; and 51—discharge back bend.

DETAILED DESCRIPTION

In order to make the objects, technical solutions and advantages of the disclosure more apparent, the disclosure is further described in detail with reference to the following examples and the accompanying drawings. Where identical components are represented by the same reference numerals. It should be noted that the words "front", "rear", "left", "right", "upper" and "lower" used in the following description refer to directions in the drawings. The terms "inner" and "outer" are used to refer to directions toward and away from, respectively, the geometric center of a particular component.

Example 1

Self-aspirating and gas-liquid dispersing impellers, as shown in FIG. 1 to FIG. 4, include a stirring shaft 1, a hub 2, a disc 3 and blades 4. The stirring shaft 1 is a hollow stirring shaft. The hub 2 is coaxially sleeved on the stirring shaft 1. The disc 3 is connected to the hub 2. A plurality of blades 4 which extend in the radial direction are arranged on the circumferential side face of the disc 3. A gas inlet channel 31 is formed in the disc 3. Each of the plurality of blades 4 includes an inclined upper curved surface 41 and an inclined lower curved surface 42. A rotary cavity 50 is embedded between the upper curved surface 41 and the corresponding lower curved surface 42. One side of the rotary cavity 50 is a liquid facing surface 46. The other side of the rotary cavity is a liquid backing surface 45. The rotary cavity 50 communicates with the stirring shaft 1 through the gas inlet channel 31.

Further, each of the plurality of blades 4 includes an upper curved surface 41, a lower curved surface 42, an outer side face 43, an inner side face 44, a liquid backing surface 45 and a liquid facing surface 46. The curved surfaces are intersected to form a main body contour edge line of each of the plurality of blades 4. An included angle between each of the inner side face 44 and the outer side face 43 and a plane of the disc 3 is 90°.

Figure 2:
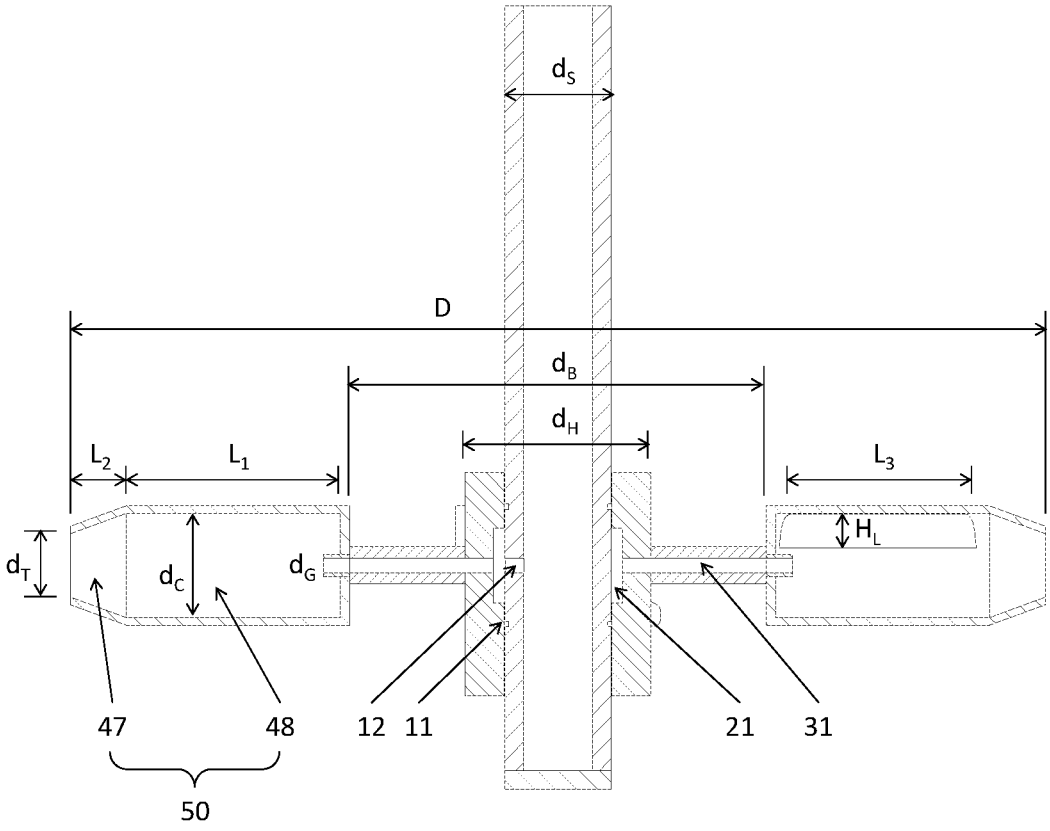
FIG. 2 is a front sectional view of the impeller according to example 1.
Figure 3:
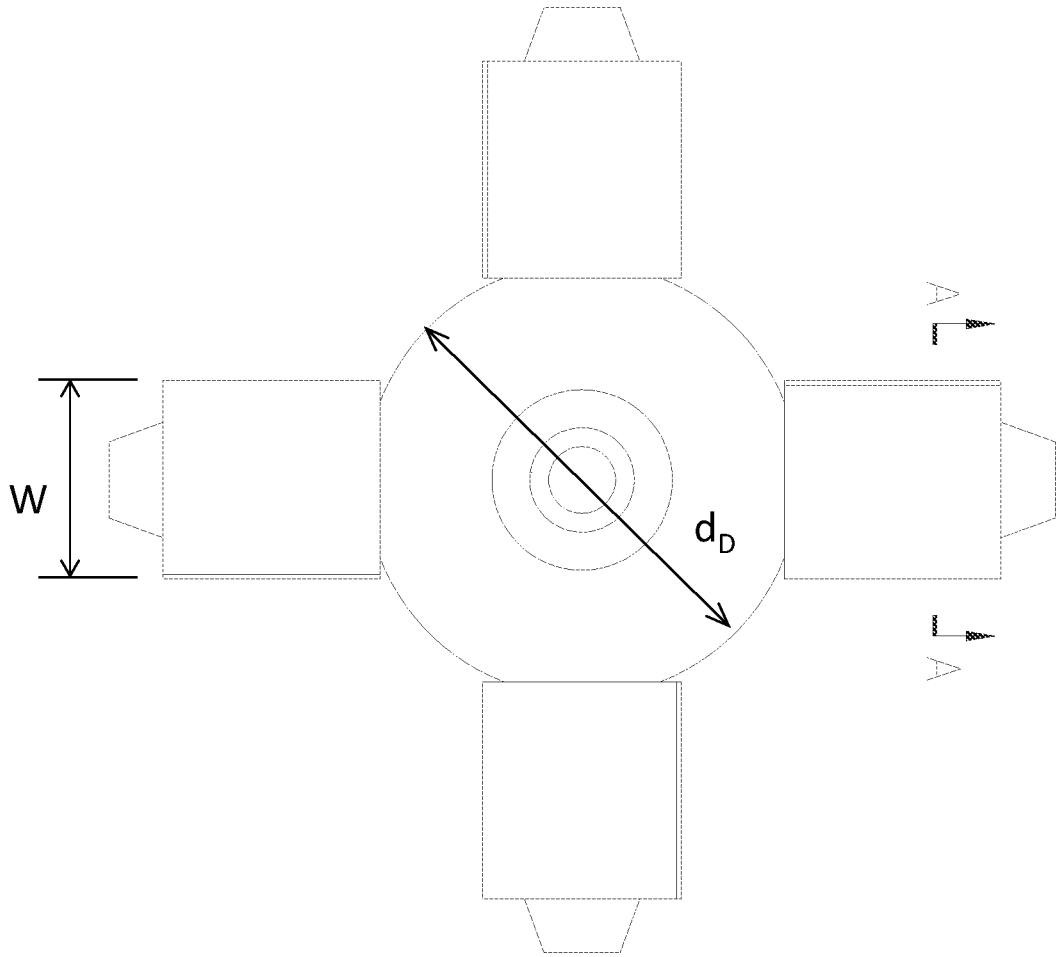
FIG. 3 is a top view of the impeller according to example 1.
Figure 4:
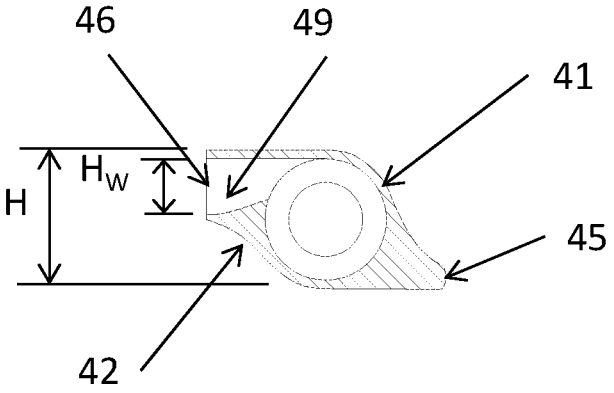
FIG. 4 is a sectional view taken along A-A direction of FIG. 3.
Figure 5:
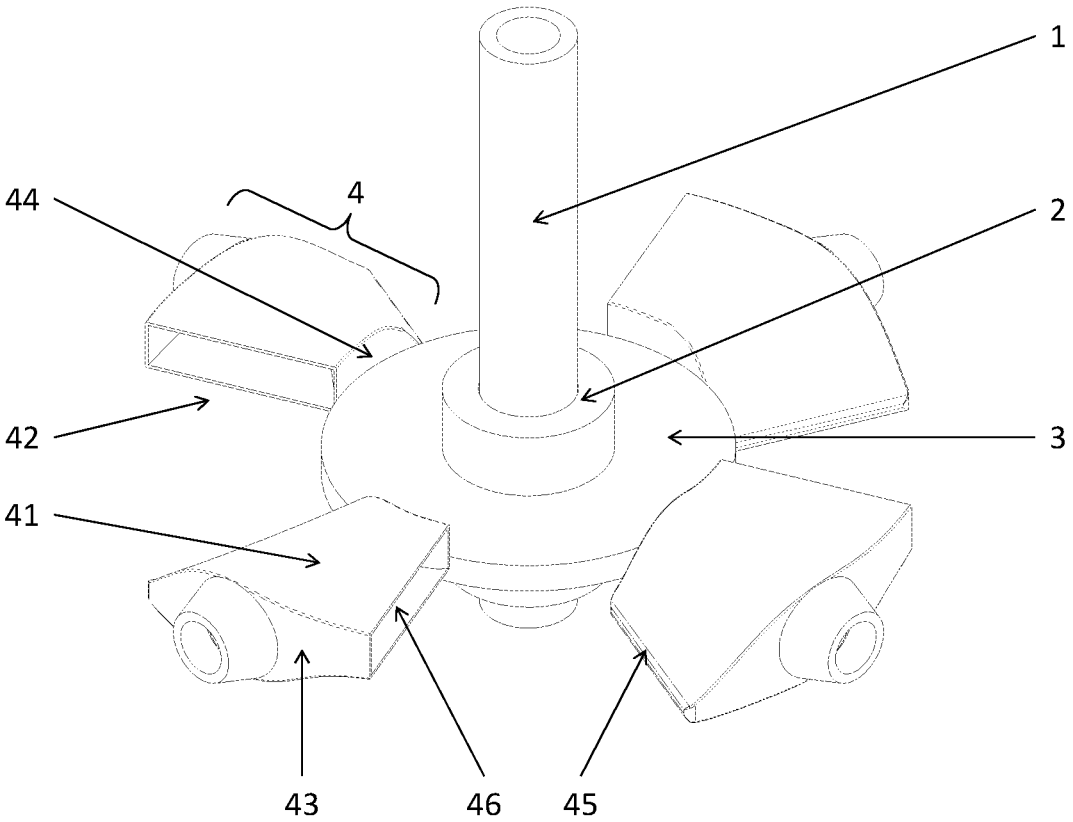
FIG. 5 is a perspective view of the impeller according to example 2.
Figure 6:
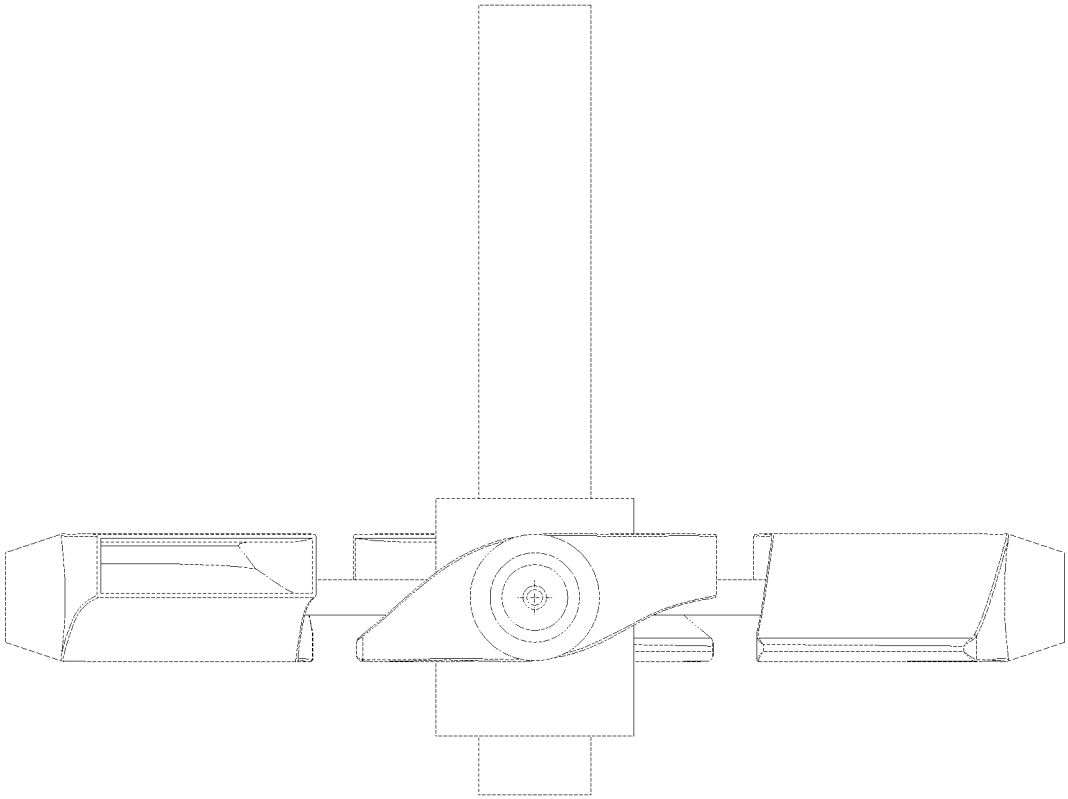
FIG. 6 is a front view of the impeller according to example 2.
Figure 7:
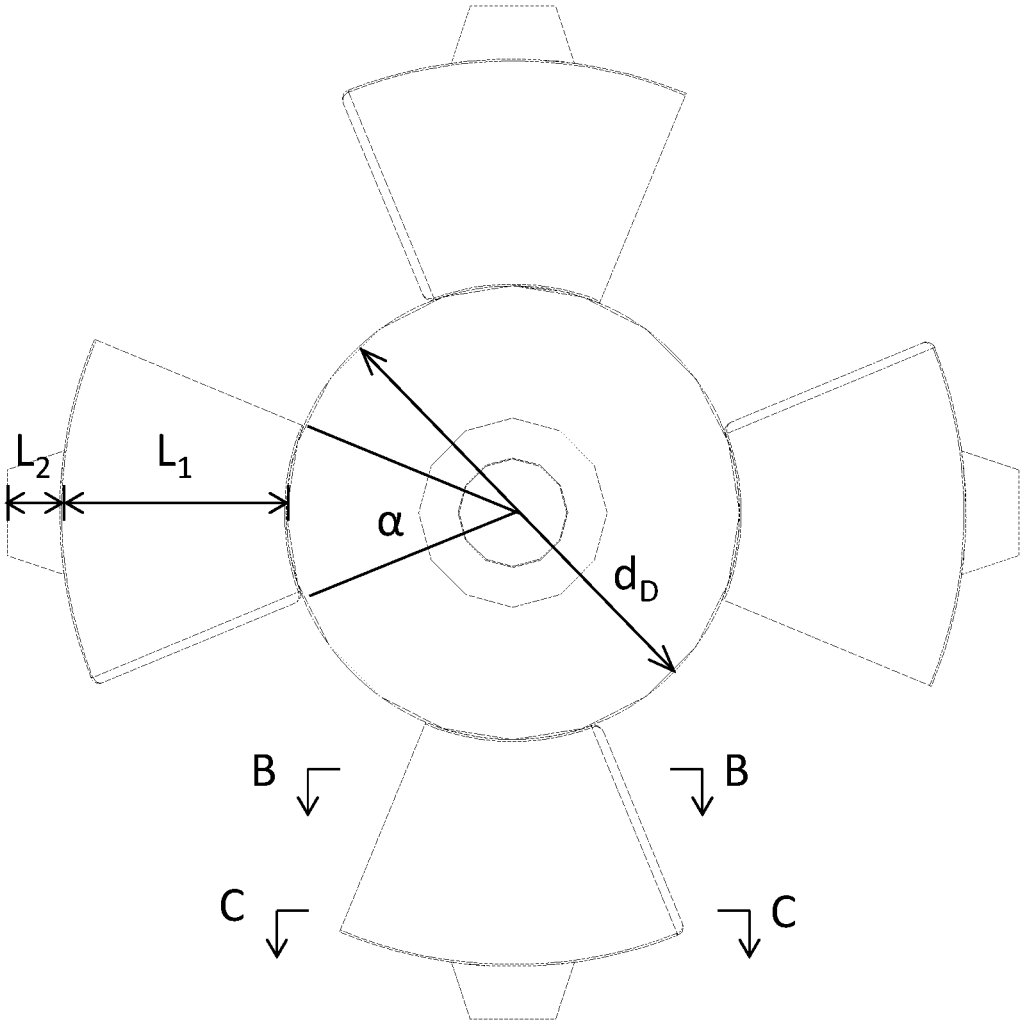
FIG. 7 is a top view of the impeller according to example 2.
Figure 8:
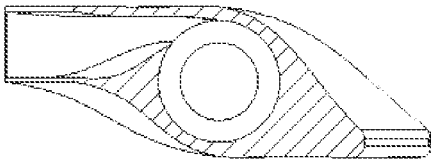
FIG. 8 is a sectional view taken along B-B direction of FIG. 7.
Figure 9:
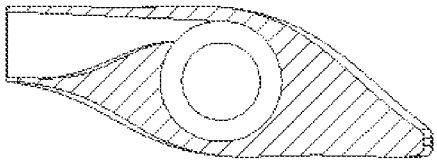
FIG. 9 is a sectional view taken along C-C direction of FIG. 7.

As shown in FIG. 2, the axis of the rotary cavity 50 is perpendicular to the axis of the stirring shaft 1. An inner side end face of the rotary cavity 50 communicates with the hollow stirring shaft 1 through the gas inlet channel 31. As shown in FIG. 4, a liquid inlet channel 49 is formed in the liquid facing surface 46. The liquid inlet channel 49 communicates with the corresponding rotary cavity 50. A cross-sectional area of an outer side end face of the rotary cavity 50 is smaller than that of the inner side end face. Gas-liquid mixture is radially discharged out of the plurality of blades 4 through the outer side end face of the rotary cavity 50.

As shown in FIG. 4, the upper curved surfaces 41 close to the directions of the liquid facing surfaces 46 gradually slope towards the horizontal plane. The upper curved surfaces 41 close to the directions of the liquid backing surfaces 45 form an inclination angle of 10-60 degrees with a horizontal plane. The lower curved surfaces 42 close to the directions of the liquid facing surfaces 46 form an inclination angle of 10-45 degrees with a horizontal plane. The lower curved surfaces 42 close to the directions of the liquid backing surfaces 45 gradually slope towards the horizontal plane.

Further, the liquid facing surfaces 46 are configured to guide liquid to enter the plurality of blades 4. The angle between the liquid facing surface 46 and the plane of the disc 3 is 60-90°. The liquid backing surfaces 45 can eliminate a cavitation effect. The upper curved surface 41 and the corresponding lower curved surface 42 converge on the corresponding liquid backing surface 45. Preferably, the upper curved surface 41 and the corresponding lower curved surface 42 converge on one straight line in the direction of the corresponding liquid backing surface 45. The two sides of the liquid backing surface 45 have the same inclination. The two sides of the liquid facing surface 46 have the same inclination.

Further, the rotary cavity 50 includes a cylindrical cavity 48 and a truncated cone cavity 47. The ratio of a diameter $d_T$ of the outer side end face to a diameter $d_C$ of the inner side end face of the rotary cavity 50 is 0.4-0.9. The ratio of a length $L_1+L_2$ of the rotary cavity 50 to the diameter $d_C$ of the inner side end face is 1.2-4. The diameter of the end face (namely the diameter of the inner side end face) of the side, close to the stirring shaft 1, of the truncated cone cavity 47 is the same as the diameter of the corresponding cylindrical cavity 48. The ratio of a height $L_2$ of the truncated cone cavity 47 to the diameter $d_C$ of the inner side end face of the corresponding rotary cavity 50 is 0.2-1. The length of each of the plurality of blades 4 is slightly greater than the length $L_1+L_2$ of the corresponding rotary cavity 50. The ratio of a width W of each of the plurality of blades 4 to the length $L_1+L_2$ of the corresponding rotary cavity 50 is 1.0-2.0.

Further, a liquid inlet channel 49 is formed in each of the plurality of blades 4 in the direction of the corresponding liquid facing surface 46, and tangentially communicates with the corresponding rotary cavity 50. The cross-sectional area of the end, close to the corresponding liquid facing surface 46, of the liquid inlet channel 49 is greater than that of the end close to the corresponding rotary cavity 50. The height $H_W$ of the end, positioned on the corresponding liquid facing surface 46, of the liquid inlet channel 49 is 0.20-0.75 of the diameter $d_C$ of the inner side end face. The height $H_L$ of the end, close to the corresponding cylindrical cavity 48, of the liquid inlet channel 49 is 0.1-0.4 of the diameter $d_C$ of the inner side end face of the corresponding cylindrical cavity. The length $L_3$ of the transverse vertical section of the liquid inlet channel 49 is smaller than the length $L_1$ of the corresponding cylindrical cavity 48. The ratio of the length of the transverse vertical section of the liquid inlet channel to the length of the corresponding cylindrical cavity is 0.45-0.95, and is preferably 0.7-0.9.

Further, one end of the gas inlet channel 31 is connected to the hollow stirring shaft 1 by means of the disc 3 and the hub 2. The other end of the gas inlet channel 31 is connected to the insides of the rotary cavity 50 of the plurality of blades 4. The ratio of the diameter of the gas inlet channel 31 to the diameter of the outer side end face of the rotary cavity 50 is 0.05-0.4, and is preferably 0.1-0.25.

Further, the disc 3 is perpendicular to the stirring shaft 1. The inner side and the outer side of the disc are respectively connected to the hub 2 and the plurality of blades 4. The gas inlet channel 31 is formed in the disc 3. The outer side of the disc 3 may be directly welded to the plurality of blades 4, or a blade pedestal is arranged on the disc 3, and then the disc is detachably connected to the plurality of blades 4 by means of each of the plurality of blades pedestal.

Further, the inner side and the outer side of the hub 2 are respectively connected to the stirring shaft 1 and the disc 3. The air groove 21 is formed in the inner side of the hub 2. The side hole 12 is formed in one side of the stirring shaft 1. The outer side of the air groove 21 communicates with the gas inlet channel 31 of the disc 3. The inner side of the air groove 21 communicates with the side hole 12 of the stirring shaft 1. The sealing rings 11 are further arranged between the stirring shaft 1 and the hub 2. The stirring shaft and the hub are sealed by means of the sealing rings 11. The number of the sealing rings 11 is two. The side hole 12 and the air groove 21 are positioned between the two sealing rings 11 to ensure communication between gas in the hollow stirring shaft 1 and the plurality of blades 4.

Further, the number of the plurality of blades 4 of the impeller is 2-8, the plurality of blades 4 are evenly distributed along the circumference of the disc 3. Preferably, the number of the plurality of blades 4 is four. The plurality of blades 4 are arranged in a pushed-down manner. The ratio of the length $L_1+L_2$ of the rotary cavity 50 to the diameter $d_b$ of the disc 3 is 0.2-0.8, and is preferably 0.5-0.7.

Further, the projections of the upper curved surfaces 41 and the lower curved surfaces 42 of the plurality of blades 4 in the plane of the disc 3 are rectangular.

The operation conditions of the self-aspirating and gas-liquid dispersing impellers are as follows: the linear velocity of the tip of each of the plurality of blades 4 is greater than 2.0 m/s, liquid viscosity is smaller than 1000 mPa·s, and the maximum size of solid particles is smaller than the lowest height of the liquid inlet channel 49. The gas-liquid mass transfer rate and efficiency of the impeller in an operation process are closely related to gas-liquid flow ratio. Liquid flow is mainly adjusted by means of the stirring rotation speed. Gas flow is pre-adjusted by means of the diameter dg of the gas inlet channel 31 and a gas inlet valve mounted on the stirring shaft 1.

Example 2

As shown in FIG. 5 to FIG. 9, the difference between this example and example 1 is that the projections of the upper curved surfaces 41 and the lower curved surfaces 42 of the plurality of blades 4 of this example in the plane of the disc 3 are fan-shaped. The widths of each of the plurality of blades 4 are defined by the central angle $\alpha$ of the sector, the radius r of the inner side face and the radius R of the outer side face. For example, the central angle of the fan $\alpha$ is 30-60 degrees, the width of the inner side face of each of the plurality of blades 4 is $\alpha\pi r/180$, and the width of the outer side face of each of the plurality of blades is $\alpha\pi R/180$. The upper curved surfaces 41 of the plurality of blades 4 close to the directions of the liquid facing surfaces 46 gradually slope towards the horizontal plane. The upper curved surfaces 41 close to the directions of the liquid backing surfaces 45 form an inclination angle of 10-60 degrees with a horizontal plane. Further, the inner side inclination of the upper curved surfaces 41 close to the directions of the liquid backing surfaces 45 is greater than the outer side inclination. The lower curved surfaces 42 close to the directions of the liquid facing surfaces 46 form an inclination angle of 10-45 degrees with a horizontal plane. The inner side inclination of the lower curved surfaces 42 close to the liquid facing surfaces 46 is greater than the outer side inclination. The lower curved surfaces 42 close to the directions of the liquid backing surfaces 45 gradually slope towards the horizontal plane.

Example 3

Figure 10:
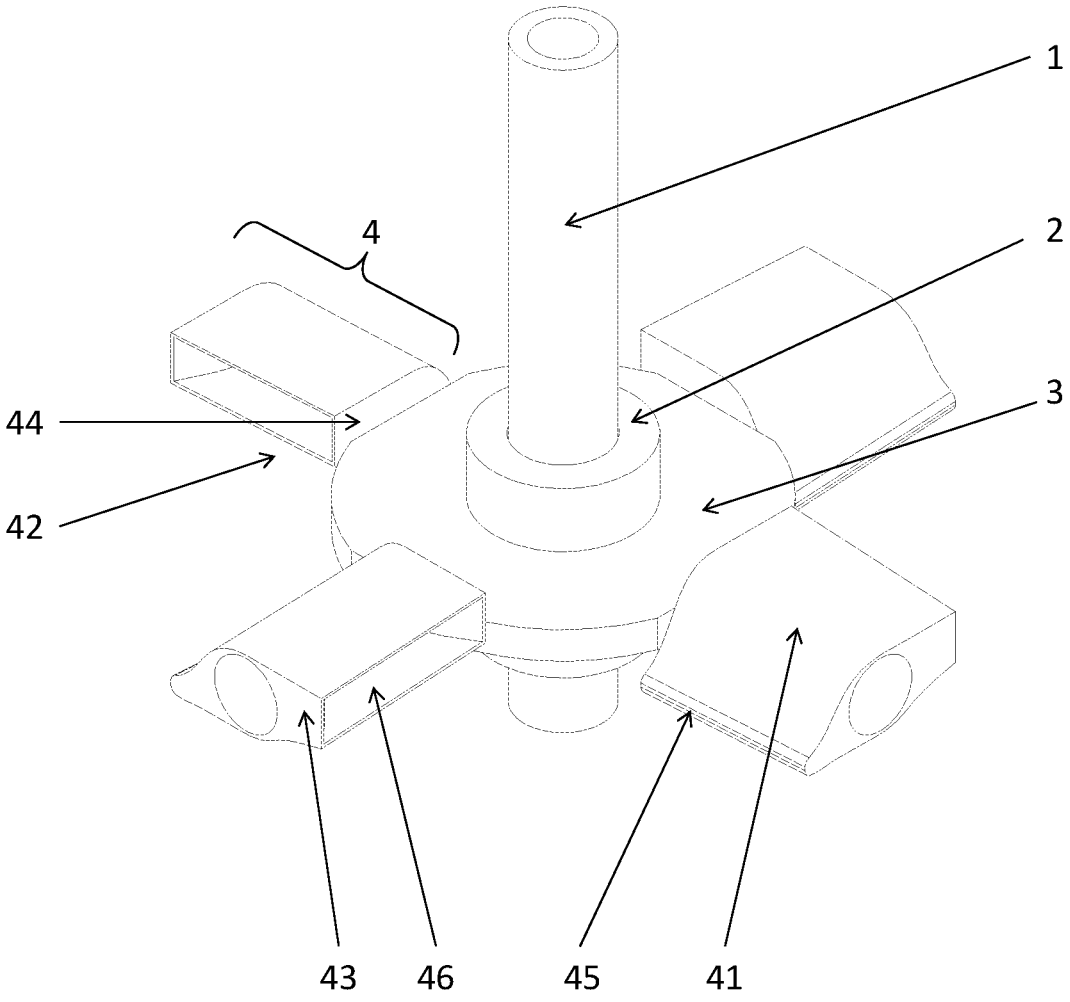
FIG. 10 is a perspective view of the impeller according to example 3.
Figure 11:
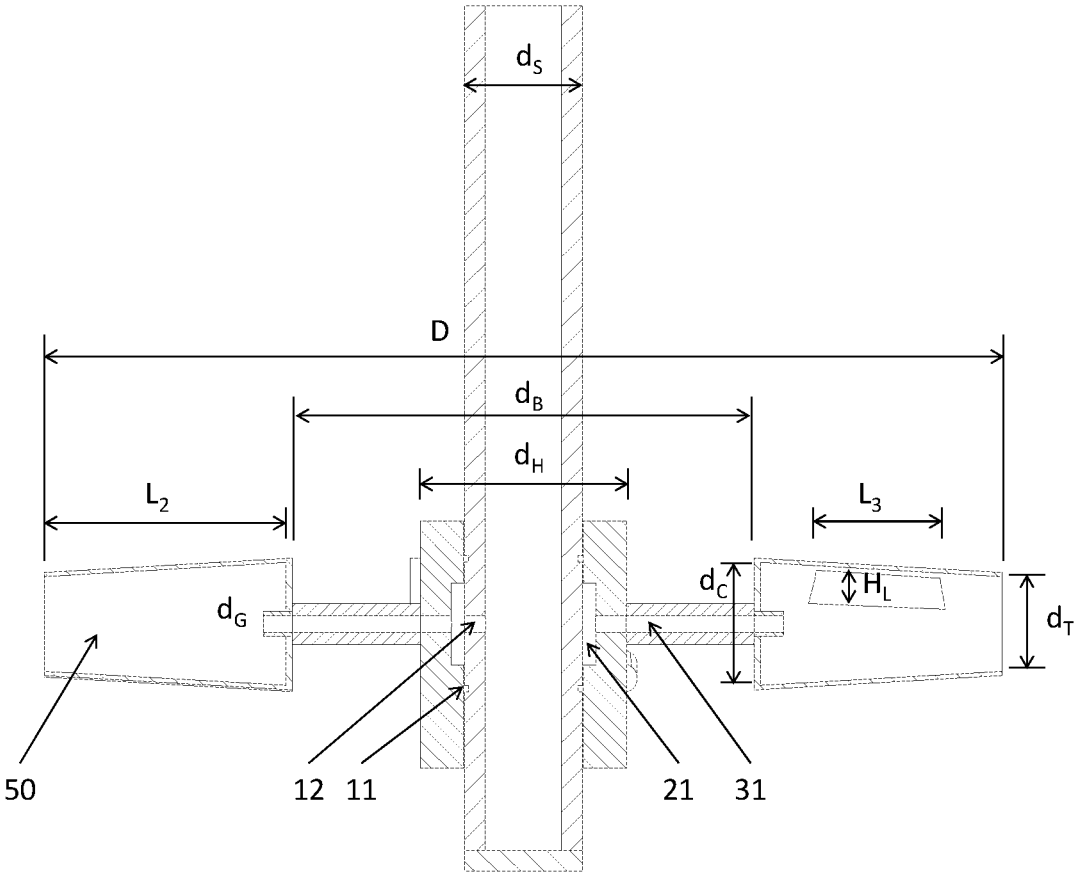
FIG. 11 is a front sectional view of the impeller according to example 3.

As shown in FIG. 10 and FIG. 11, the difference between this example and example 1 is that the projections of the upper curved surfaces 41 and the lower curved surfaces 42 of the plurality of blades 4 of this example in the plane of the disc 3 are trapezoidal. Namely, the rotary cavity 50 in this example is a single truncated cone cavity. The ratio of the diameter $d_T$ of the outer side end face of the rotary cavity 50 to the diameter $d_C$ of the inner side end face is 0.5-0.9. The ratio of the length $L_2$ of the rotary cavity 50 to the diameter $d_C$ of the inner side end face is 1.5-4.

Further, the radial vertical section of the liquid inlet channel 49 is parallelogram or trapezoid. The cross-sectional area of the end at the corresponding liquid facing surface 46, of the liquid inlet channel is larger while the cross-sectional area of the end, adjacent to the corresponding truncated cone cavity, of the liquid inlet channel tends to be small. The liquid inlet channel tangentially communicates with the corresponding truncated cone cavity. The liquid facing surface 46 is larger than that of the end adjacent to the rotary cavity 50, the height $H_W$ of the liquid inlet channel 49 at the end adjacent to the corresponding liquid facing surface 46 is 0.2-0.75 of the diameter $d_C$ of the inner side end face of the corresponding rotary cavity 50. The height $H_L$ of the liquid inlet channel 49 at the end adjacent to the cylindrical cavity 48 is 0.1-0.4 of the diameter $d_C$ of the inner side end face of the corresponding rotary cavity 50. The length $L_3$ of the radial vertical section of the end, close to the corresponding truncated cone cavity, of the liquid inlet channel 49 is smaller than the length $L_2$ of the corresponding truncated cone cavity. The ratio of the length of the radial vertical section of the end, close to the corresponding truncated cone cavity, of the liquid inlet channel to the length of the corresponding truncated cone cavity is 0.45-0.7.

Example 4

Figure 12:
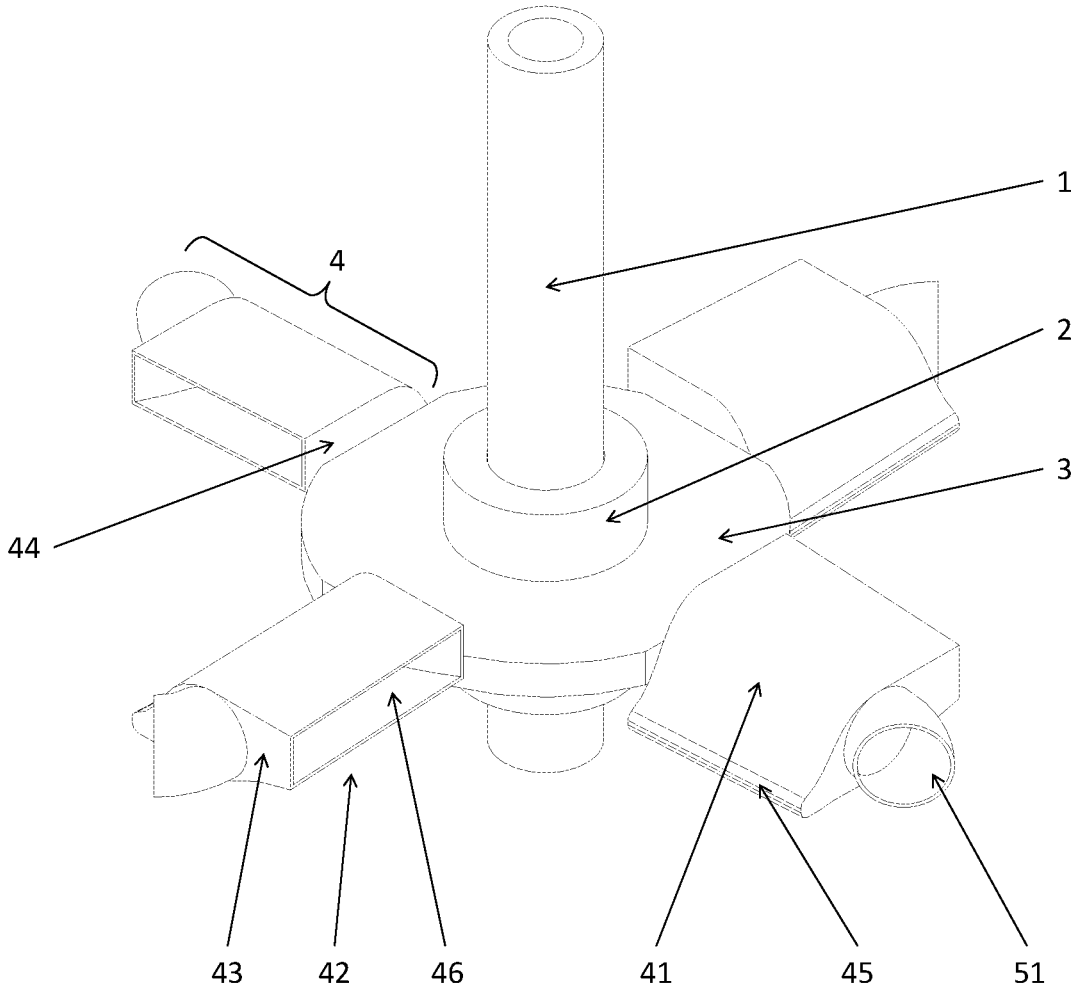
FIG. 12 is a perspective view of the impeller according to example 4.
Figure 13:
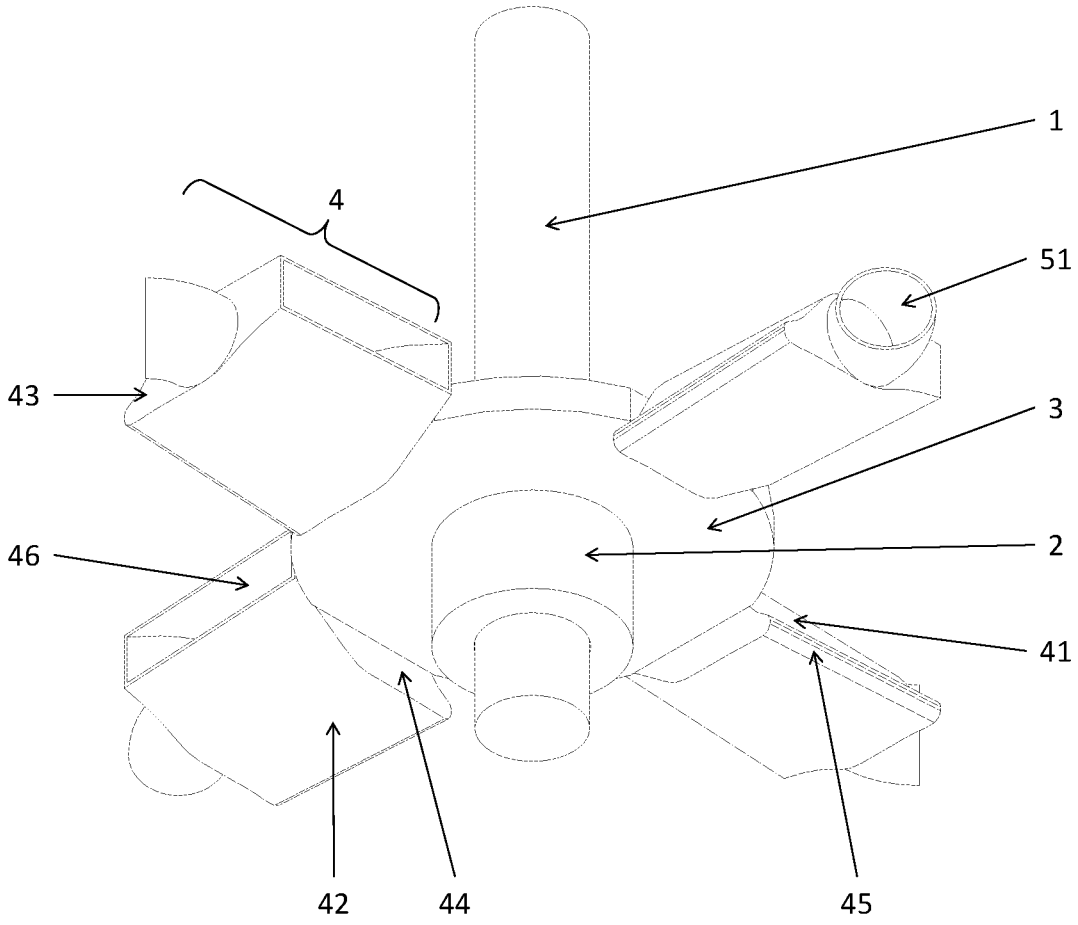
FIG. 13 is a perspective view of the impeller according to example 4 from another perspective.

As shown in FIG. 12, the difference between this example and example 1 is that the outer side end face of each of the plurality of blades 4 of this example is connected to a discharge back bend 51 facing the corresponding liquid backing surface 45. The rotation plane of the discharge back bend 51 is parallel to the plane of the disc. The back-bending rotation angle is 40-90 degrees. By arrangement of the discharge back bends 51, gas-liquid mixture can be discharged out of the plurality of blades more quickly, higher negative pressure is formed inside the plurality of blades. The discharge back bends 51 are suitable for occasions with the installation positions being deeper from the liquid level.

Example 5

The self-aspirating and gas-liquid dispersing impellers are provided, as shown in FIG. 1 to FIG. 4. This example is specifically implemented on the basis of example 1, as shown in FIG. 4. The upper curved surfaces 41 close to the directions of the liquid facing surfaces 46 gradually slope towards the horizontal plane. The upper curved surfaces 41 close to the directions of the liquid backing surfaces 45 form an inclination angle of 40 degrees with a horizontal plane. The lower curved surfaces 42 close to the directions of the liquid facing surfaces 46 form an inclination angle of 25 degrees with a horizontal plane. The lower curved surfaces 42 close to the directions of the liquid backing surfaces 45 gradually slope towards the horizontal plane.

The liquid facing surfaces 46 are configured to guide liquid to enter the plurality of blades 4. An angle between the liquid facing surface 46 and the plane of the disc 3 is 70 degrees. The liquid backing surfaces 45 may eliminate the cavitation effect. The upper curved surface 41 and the corresponding lower curved surface 42 converge on the corresponding liquid backing surface 45. Preferably, the upper curved surface 41 and the corresponding lower curved surface 42 converge on one straight line in the direction of the corresponding liquid backing surface 45. The two sides of the liquid backing surface 45 have the same inclination. The two sides of the liquid facing surface 46 have the same inclination.

The rotary cavity 50 includes a cylindrical cavity 48 and a truncated cone cavity 47. The diameter $d_T$ of the outer side end face of the rotary cavity 50 is 40 mm. The ratio of the diameter $d_T$ of the outer side end face to the diameter $d_C$ of the inner side end face of the rotary cavity 50 is 0.70. The ratio of the length $L_1+L_2$ of the rotary cavity 50 to the diameter $d_C$ of the inner side end face is 1.375. The diameter of the end face (namely the diameter of the inner side end face) of the side, close to the stirring shaft 1, of the truncated cone cavity 47 is the same as the diameter of the corresponding cylindrical cavity 48. The ratio of the height $L_2$ of the truncated cone cavity 47 to the diameter $d_C$ of the inner side end face of the corresponding rotary cavity 50 is 0.375. The length of each of the plurality of blades 4 is slightly greater than the length $L_1+L_2$ of the corresponding rotary cavity 50. The ratio of the width W of each of the plurality of blades 4 to the length $L_1+L_2$ of the corresponding rotary cavity 50 is 1.4.

A liquid inlet channel 49 is formed in each of the plurality of blades 4 in the direction of the corresponding liquid facing surface 46, and tangentially communicates with the corresponding rotary cavity 50. The cross-sectional area of the end, close to the corresponding liquid facing surface 46, of the liquid inlet channel 49 is greater than that of the end close to the corresponding rotary cavity 50. The height $H_W$ of the end, positioned on the corresponding liquid facing surface 46, of the liquid inlet channel 49 is 0.3 of the diameter $d_C$ of the inner side end face. The height $H_L$ of the end, close to the corresponding cylindrical cavity 48, of the liquid inlet channel 49 is 0.15 of the diameter $d_C$ of the inner side end face of the corresponding cylindrical cavity. The length $L_3$ of the transverse vertical section of the liquid inlet channel 49 is smaller than the length $L_1$ of the corresponding cylindrical cavity 48. The ratio of the length of the transverse vertical section of the liquid inlet channel to the length of the corresponding cylindrical cavity is 0.7.

One end of the gas inlet channel 31 is connected to the hollow stirring shaft 1 by means of the disc 3 and the hub 2. The other end of the gas inlet channel 31 is connected to the insides of the rotary cavity 50 of the plurality of blades 4. The ratio of the diameter of the gas inlet channel 31 to the diameter of the outer side end face of the rotary cavity 50 is 0.15.

The disc 3 is perpendicular to the stirring shaft 1. The inner side and the outer side of the disc are respectively connected to the hub 2 and the plurality of blades 4. The gas inlet channel 31 is formed in the disc 3. The outer side of the disc 3 is directly welded to the plurality of blades 4.

The total diameter of the impeller is 200 mm. The number of the plurality of blades 4 is four. The plurality of blades 4 are evenly distributed along the circumference of the disc 3. The plurality of blades 4 are arranged in a pushed-down manner. The diameter $d_b$ of the disc 3 is 90 mm. The projections of the upper curved surfaces 41 and the lower curved surfaces 42 of the plurality of blades 4 in the plane of the disc 3 are rectangular.

A conventional four-blade Bakker Turbine (BT-4 for short) and a four-blade Rushton Turbine (RT-4 for short) are used as a contrast to compare with the case of the disclosure. The main body sizes of BT-4 and RT-4 are as follows: the whole size is 200 mm, the diameter of the disc is 120 mm, the length of each of the plurality of blades is 55 mm, and the size of the hub is consistent with that of the impeller of the disclosure. The height of each of the plurality of blades of RT-4 is 40 mm. The thickness of each of the plurality of blades is 2 mm. The height of each of the plurality of blades of BT-4 is 40 mm. The thickness of each of the plurality of blades is 2 mm. The circumferential vertical section of each of the plurality of blades is in a parabola shape. The width of the upper half part of the parabola is 40 mm. The height of the upper half part of the parabola is 22 mm. The width of the lower half part of the parabola is 30 mm. The height of the lower half part of the parabola is 18 mm.

The three impeller blades have the operation conditions that the diameter of a stirring tank is 600 mm, the linear velocity of the tip of each of the plurality of blades is 5.0 m/s, the experiment is carried out in a water-air system, and air flow is 150 L/min. The results of analysis measurement of oxygen transfer efficiency show that the oxygen transfer efficiency of the impeller in example 5 is improved by 18% and 32% compared with the conventional BT-4 and RT-4, which shows that the impeller blade in example 5 shows good oxygen transfer performance.

The operation conditions of the self-aspirating and gas-liquid dispersing impellers provided by the disclosure are as follows: the linear speed of the tip of each of the plurality of blades 4 is greater than 2.0 m/s. The maximum size of solid particles is smaller than the lowest height of the liquid inlet channel 49. The gas-liquid mass transfer rate and efficiency of the impeller in the operation process are closely related to gas-liquid flow ratio and liquid property. Liquid flow is mainly adjusted by means of stirring rotation speed. Gas flow rate is pre-adjusted by means of the diameter dg of the gas inlet channel 31 and the gas inlet valve mounted on the stirring shaft 1.

Although the disclosure has been described in detail with reference to the foregoing examples, it will be apparent to those skilled in the art that the technical solutions described in the foregoing examples can still be modified, or part of technical characteristics of the technical solutions can be equivalently replaced, and any modification, equivalent replacement, improvement and the like within the spirit and principle of the disclosure should be included in the scope of protection of the disclosure.

What is claimed is:

1. An impeller comprising: a stirring shaft (1), a hub (2), a disc (3) and a plurality of blades (4);

the stirring shaft (1) being a hollow stirring shaft, the hub (2) being coaxially sleeved on the stirring shaft (1), the disc (3) being connected to the hub (2), the plurality of blades (4) which extend in the radial direction being arranged on the circumferential side face of the disc (3), and a gas inlet channel (31) being formed in the disc (3);

each of the plurality of blades (4) comprising an upper curved surface (41) and a lower curved surface (42), a rotary cavity (50) being embedded between the upper curved surface (41) and the corresponding lower curved surface (42), and the rotary cavity (50) communicating with the hollow stirring shaft (1) through the gas inlet channel (31);

one side of the rotary cavity (50) is a liquid facing surface (46), the other side of the rotary cavity is a liquid backing surface (45), a liquid inlet channel (49) is formed in the liquid facing surface (46), and the liquid inlet channel (49) communicates with the corresponding rotary cavity (50); and the upper curved surface (41) and the corresponding lower curved surface (42) converge on the corresponding liquid backing surface (45).

2. The impeller according to claim 1, wherein an air groove (21) is formed in an inner side of the hub (2), and a side hole (12) is formed in one side of the stirring shaft (1); and an outer side of the air groove (21) communicates with the gas inlet channel (31) of the disc (3), and the inner side of the air groove (21) communicates with the side hole (12) of the stirring shaft (1).

3. The impeller according to claim 2, wherein sealing rings (11) are further arranged between the stirring shaft (1) and the hub (2), the number of the sealing rings (11) is two, the side hole (12) and the air groove (21) are positioned between two sealing rings (11), and the disc (3) is connected to the plurality of blades (4) in a welded or detachable manner.

4. The impeller according to claim 3, wherein projections of upper curved surfaces (41) and lower curved surfaces (42) of the plurality of blades (4) in a plane of the disc (3) are rectangular, fan-shaped or trapezoidal;

each of the upper curved surfaces (41) has a horizontal region near the liquid facing surfaces (46);

each of the upper curved surfaces (41) has a first inclined region near the liquid backing surfaces (45), and the first inclined region forms an inclination angle of 10-60 degrees with a horizontal plane;

each of the lower curved surfaces (42) has a second inclined region near the liquid facing surfaces (46), and the second inclined region forms an inclination angle of 10-45 degrees with a horizontal plane; and each of the lower curved surfaces (42) has a horizontal region near the liquid backing surfaces (45).

5. The impeller according to claim 4, wherein the rotary cavity (50) is a single truncated cone cavity (47) or a combination of a cylindrical cavity (48) and a truncated cone cavity (47), and a cross-sectional area of an outer side end face of the rotary cavity (50) is smaller than that of an inner side end face.

6. The impeller according to claim 5, wherein each of the plurality of blades (4) further comprises an outer side face (43) and an inner side face (44), the outer side face (43) and the inner side face (44) are planes or cylindrical curved surfaces, the liquid facing surfaces (46) are configured to guide liquid to enter the plurality of blades (4), an angle between the liquid facing surface (46) and the plane of the disc (3) is 60-90°.

7. The impeller according to claim 6, wherein when the rotary cavity (50) is the combination of the cylindrical cavity (48) and the truncated cone cavity (47), the ratio of a diameter of the outer side end face to a diameter of the inner side end face of the rotary cavity (50) is 0.4-0.9, the ratio of a length of the rotary cavity (50) to the diameter of the inner side end face is 1.2-4, the ratio of a height of the truncated cone cavity (47) to the diameter of the inner side end face of the rotary cavity (50) is 0.2-1, and the ratio of a width of each of the plurality of blades (4) to the length of the rotary cavity (50) is 1-2; and when the rotary cavity (50) is the single truncated cone cavity (47), the ratio of the diameter of the outer side end face to the diameter of the inner side end face of the rotary cavity (50) is 0.5-0.9, and the ratio of the length of the rotary cavity (50) to the diameter of the inner side end face is 1.5-4.

8. The impeller according to claim 7, wherein the cross-sectional area of the liquid inlet channel (49) at the end adjacent to the liquid facing surface (46) is larger than that of the end adjacent to the rotary cavity (50), the height of the liquid inlet channel (49) at the end adjacent to the corresponding liquid facing surface (46) is 0.2-0.75 of the diameter of the inner side end face of the corresponding rotary cavity (50), the height of the liquid inlet channel (49) at the end adjacent to the cylindrical cavity (48) is 0.1-0.4 of the diameter of the inner side end face of the corresponding rotary cavity (50).

9. The impeller according to claim 8, wherein the ratio of the diameter of the gas inlet channel (31) to the diameter of the outer side end face of the rotary cavity (50) is 0.05-0.4.

10. The impeller according to claim 9, wherein the number of the plurality of blades (4) is 2-8, the plurality of blades (4) are evenly distributed along the circumference of the disc (3), and the ratio of the length of the rotary cavity (50) to the diameter of the disc (3) is 0.2-0.8.

* * * * *